US006913485B2

(12) United States Patent
Ko

(10) Patent No.: US 6,913,485 B2
(45) Date of Patent: Jul. 5, 2005

(54) MICRO COAXIAL CABLE ASSEMBLY HAVING IMPROVED CONTACTS

(75) Inventor: David Tso-Chin Ko, Cypress, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/677,579

(22) Filed: Oct. 1, 2003

(65) Prior Publication Data

US 2005/0075009 A1 Apr. 7, 2005

(51) Int. Cl.[7] ..... H01R 13/648
(52) U.S. Cl. ..... 439/579; 439/610
(58) Field of Search ..... 439/579, 610, 439/108, 352, 357, 497

(56) References Cited

U.S. PATENT DOCUMENTS 5,163,856 A * 11/1992 McGaffigan et al. ..... 439/874
5,749,746 A * 5/1998 Tan et al. ..... 439/357
5,775,931 A 7/1998 Jones
D444,130 S 6/2001 Hayashi et al.
6,273,753 B1 8/2001 Ko
6,305,978 B1 10/2001 Ko
6,338,652 B1 1/2002 Ko
6,380,485 B1 * 4/2002 Beaman et al. ..... 174/88 R
D456,777 S 5/2002 Igarashi
D456,779 S 5/2002 Igarashi
D456,780 S 5/2002 Igarashi
D457,138 S 5/2002 Igarashi

* cited by examiner

*Primary Examiner*—Alex Gilman
(74) *Attorney, Agent, or Firm*—Wei Te Chung

(57) ABSTRACT

An electrical connector assembly (100) comprises an elongate insulative housing (1), a contact set (2), a shield (3), and a plurality of cables (6). The housing has a base portion (11) and a plurality of passageways (111) defined in the base portion. The contacts set is assembled into a rear end of the housing. The contact set comprises an insulative insert (21), a plurality of signal and grounding contacts (22) and a grounding bar (23) assembled in the insert. Each contact comprises a mating section (224) extending beyond the insulative insert and received into the corresponding passageways of the housing and a connecting section (226) remained in the insert, and a step section (228) between the mating section and the connecting section so that the mating section is not coplanar with the connecting section. The plurality of cables extends into the insulative insert and is electrically soldered to the connecting sections.

8 Claims, 8 Drawing Sheets

MICRO COAXIAL CABLE ASSEMBLY HAVING IMPROVED CONTACTS

CROSS-REFERENCE TO RELATED APPLICATION

This patent application relates to two copending application Ser. Nos. 10/246,259 and 10/199,713.

BACKGROUND OF THE INVENTION

1. Field of the Invention

The present invention relates to a micro coaxial cable assembly used in liquid crystal display (LCD) application, and particularly to such cable assembly having improved contacts.

2. Description of Related Art

U.S. Pat. Nos. 6,305,978 B1, 6,273,753 B1, 6,338,652 B1, D456,779 S, D456,780 S, D456,777 S, D457,138 S, and D444,130 S disclose low profiled micro coaxial cable connectors. This type connector is used to transmit signals between a mother board in a base of a notebook computer and an LCD panel of the notebook computer. In the old design, the micro coaxial cable connector assembly has the planar contacts and each contact comprises a mating portion and a soldering portion opposite to the mating portion. The soldering portion has a soldering surface and the mating portion has a mating surface, the soldering surface and the mating surface are coplanar. When soldering, a conductor of a micro coaxial cable is placed on the soldering surface of the solder portion and a solid solder is attached on the conductor. When the solid solder is heated, the solid solder is melted and the melted solder flows to the mating surface of the mating portion so that the mating surface of the contact is contaminated thereby influencing signal transmission. The present invention is an improvement of the contact of the connector assembly to resolve the contamination problem.

SUMMARY OF THE INVENTION

Accordingly, one object of the present invention is to provide a micro coaxial cable assembly having improved contacts which can prevent from any flux contamination problem occurring.

In order to achieve the object set forth, an electrical connector assembly comprises an elongate insulative housing, a contact set, a shield, and a plurality of cables. The housing has a base portion and a plurality of passageways is defined in the base portion. The contacts set is assembled into a rear end of the housing. The contact set comprises an insulative insert, a plurality of signal and grounding contacts and a grounding bar assembled in the insert. Each contact comprises a mating section extending beyond the insulative insert and received into the corresponding passageways of the housing and a connecting section remained in the insert, and a step section between the mating section and the connecting section so that the mating section is not coplanar with the connecting section. The plurality of cables extends into the insulative insert and is electrically soldered to the connecting sections.

Other objects, advantages and novel features of the invention will become more apparent from the following detailed description when taken in conjunction with the accompanying drawings.

DETAILED DESCRIPTION OF THE INVENTION

Figure 1:
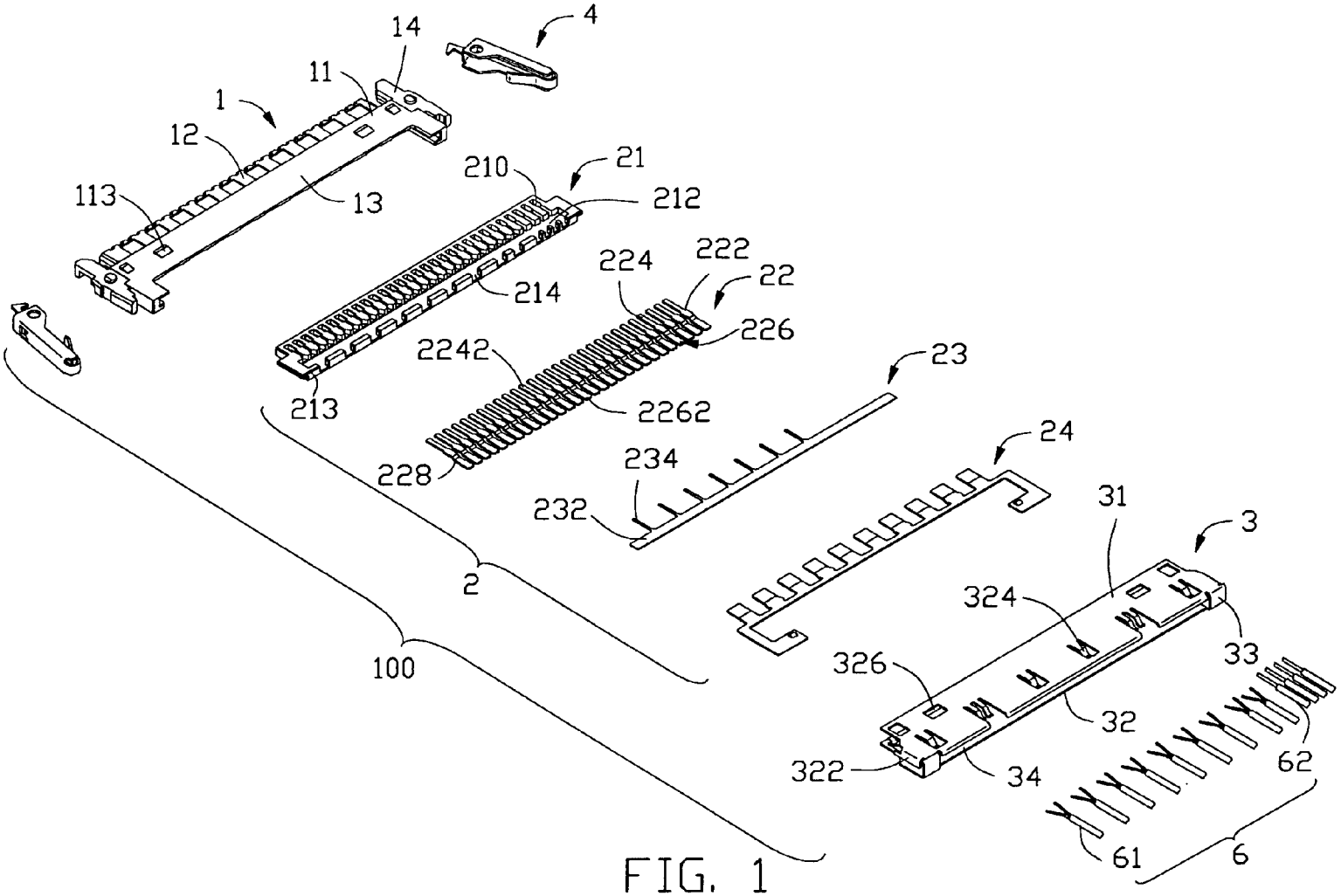
FIG. 1 is an exploded view of a micro coaxial cable assembly from a rear aspect in accordance with the present invention.
Figure 2:
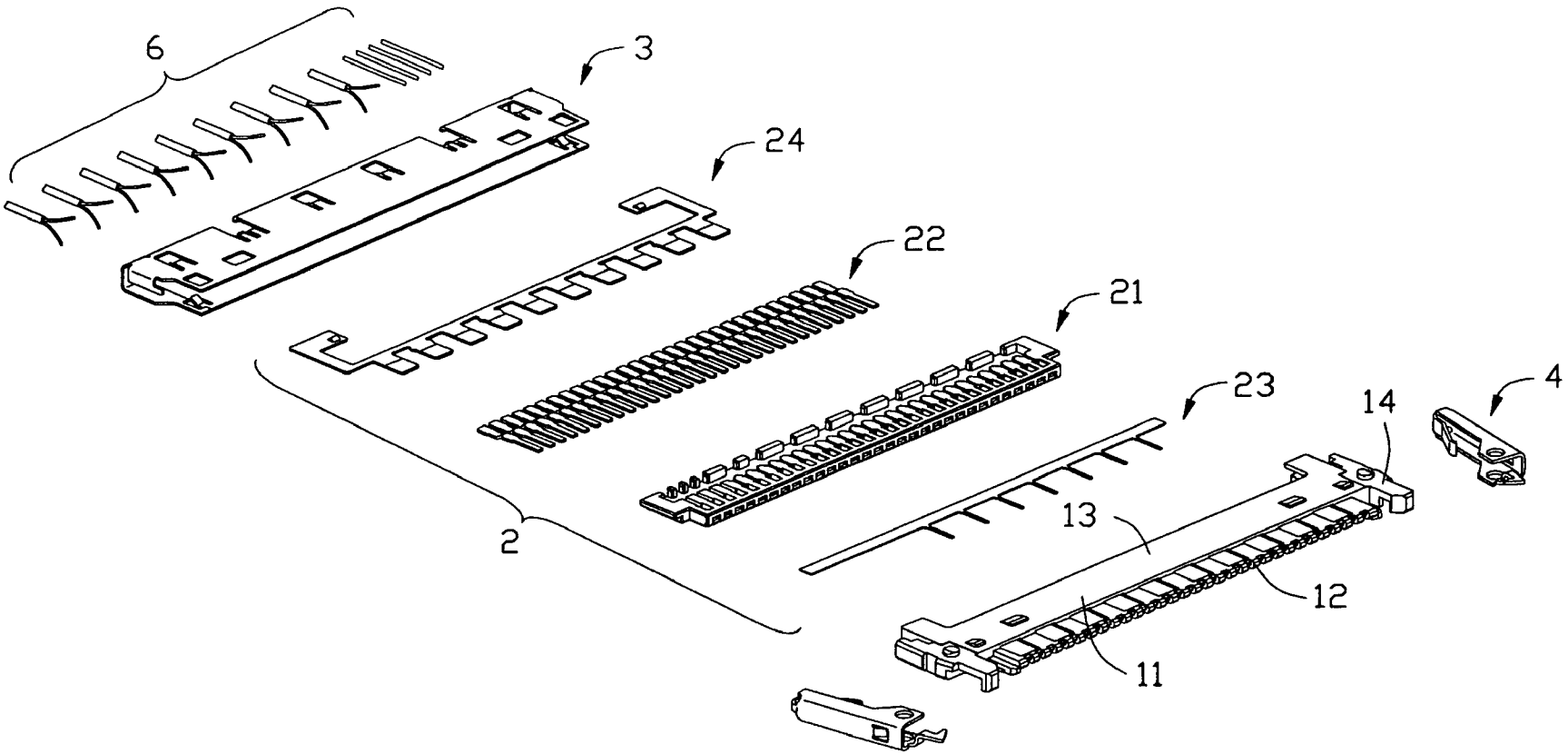
FIG. 2 is a view similar to FIG. 1, from a front aspect.
Figure 3:
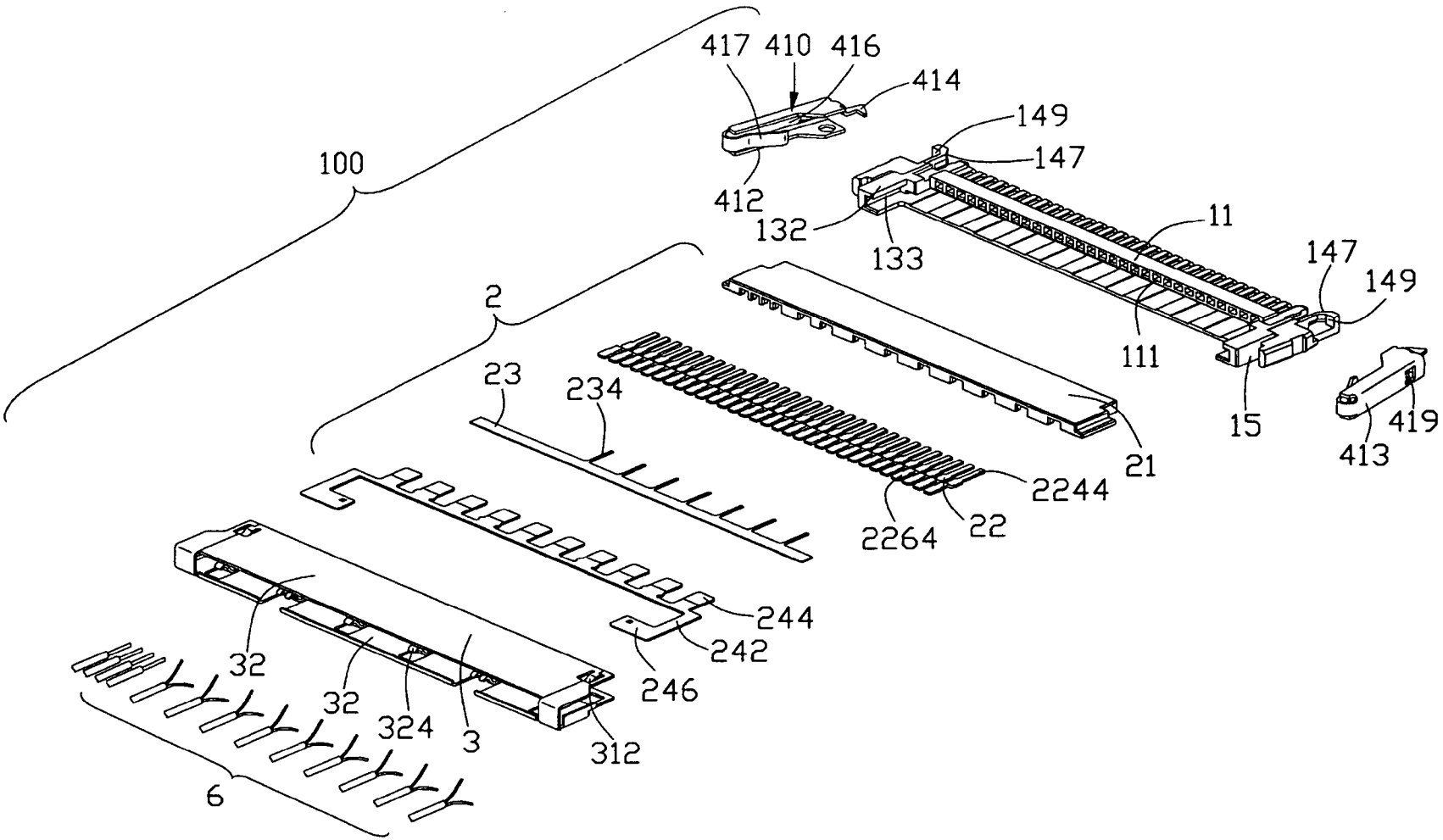
FIG. 3 is a view similar to FIG. 1, from an upside-down aspect.
Figure 4:
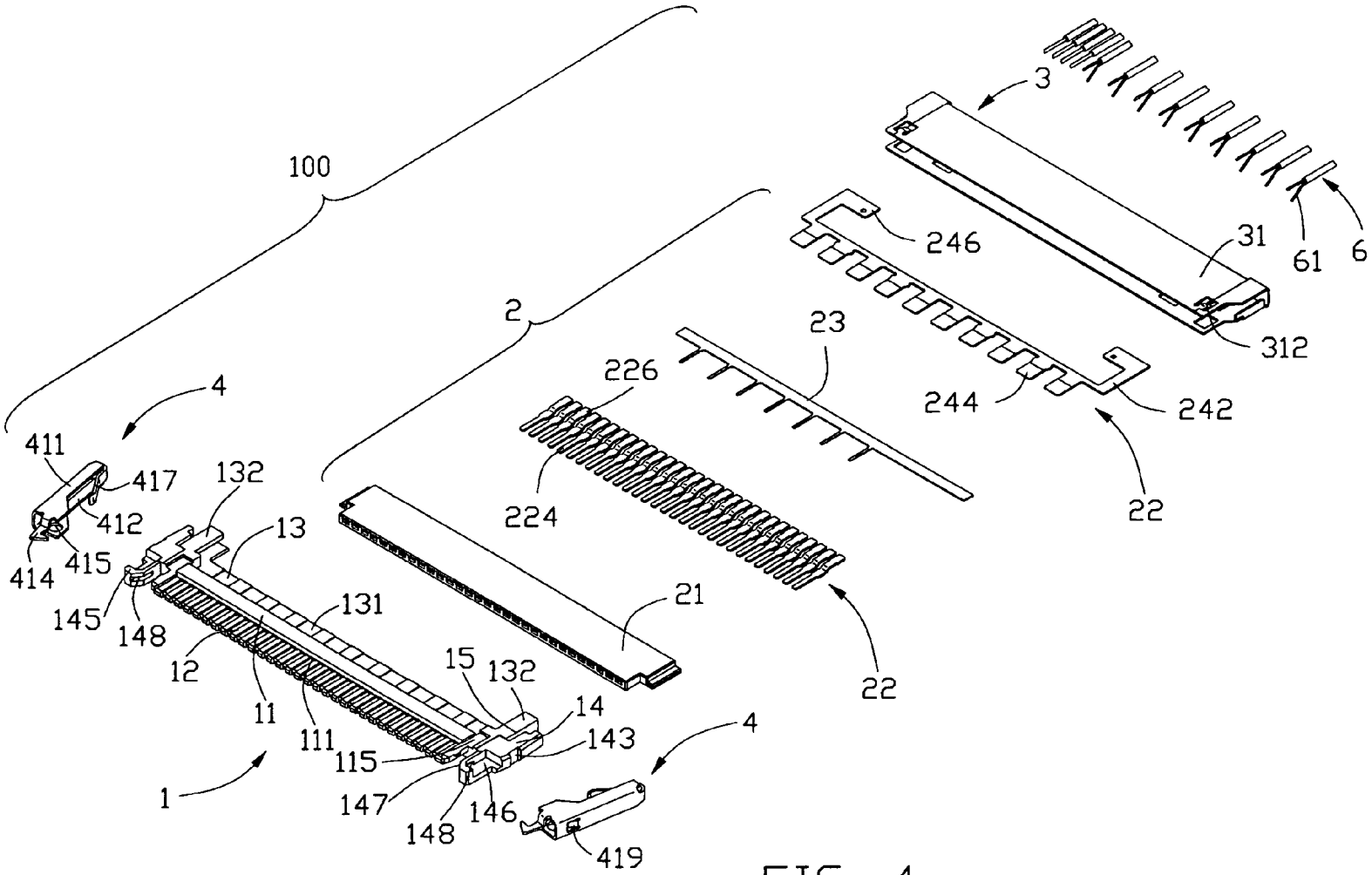
FIG. 4 is a view similar to FIG. 2, from an upside-down aspect.

Referring to FIGS. 1–4, a micro coaxial cable assembly 100 of the present invention comprises an elongate insulative housing 1, a contact set 2, a shield 3, a pair of latch devices 4, and a plurality of cables 6.

The insulative housing 1 comprises an elongate base portion 11, a tongue portion 12 extending forwardly from the base portion 11, a rear portion 13 at a rear end of the base portion 11, and a pair of retention portions 14 formed on a pair of lateral ends of the base portion 11. The base portion 11 and the tongue portion 12 together define a plurality of passageways 111 from the rear end of the base portion 11 to a front end of the tongue portion 12. The rear portion 13 comprises an elongate plate 131 extending rearwardly from the base portion 11, a pair of receiving sections 132 formed on lateral ends of the elongate plate 131. Each of the receiving sections 132 defines a receiving channel 133 in an inner side thereof. A gap 15 is defined between each retention portion 14 and a corresponding receiving section 132. A retention post 142 is formed on an upper surface of each of the retention portions 14, and the posts 142 each comprise an upper face 1421 with a laterally inclining portion 1422 (FIG. 5) for facilitating mounting of latches onto the retention portions 14. A pair of guiding posts 145 extends forwardly from front ends of the retention portions 14 and each guiding post 145 has a recess 146 in a top face thereof. The recess 146 is so located that an upright wall 149 is formed on front and inner edges of each guiding post 145. The guiding posts 145 have flared front ends 147 for facilitating a mating of a complementary connector with the cable assembly 100. A passageway 148 is defined in each of the upright walls 149, communicating with a corresponding recess 146 and extending from a corresponding flared front end 147 rearwards a distance. A plurality of protrusions 113 is formed on a bottom face 144 of the base portion 11. A pair of recesses 115 is defined in a bottom surface of the base portion 11 adjacent to the retention portions 14.

The contact set 2 comprises an insulative insert 21, a plurality of signal and grounding contacts 22, a grounding bar 23, and a grounding plate 24.

The insulative insert 21 defines a plurality of channels 210 adjacent to a front end thereof, a receiving groove 212 adjacent to a rear end thereof. The channels 210 communicate with the receiving groove 212. The channels 210 are extended in a front-to-rear direction. The groove 212 is laterally extended. A plurality of slots 214 extends through a rear face 213 of the insert 21 and communicates with the receiving groove 212. The slots 214 are used to allow a plurality of cables (not shown) extending therethrough into the receiving groove 212 and the channels 210.

The signal and grounding contacts 22 have the same structure; each contact 22 comprises a retention section 222, a mating section 224 extending forwardly from the retention section 222, and a connecting section 226 extending rearwardly from the retention section 222. Each mating section 224 has an upper surface 2242 and a contacting surface 2244 opposite to the upper surface 2242 and adapted for connecting with the complementary connector. Each connecting section 226 has a soldering surface 2262 adapted for soldering with a conductor of the cable and a lower surface 2264 opposite to the soldering surface 2262. A bending step section 228 is formed between the retention section 222 and the connecting section 226, so that the upper surface 2242 of the mating section 224 is not coplanar to and higher than the soldering surface 2262 of the connecting section 226. The upper surface 2242 of the mating section 224 is higher than the soldering surface 2262 of the connecting section 226. The mating sections 224 are for electrically engaging with the complementary connector. The connecting sections 226 are for electrically connecting with conductors of the wires.

The grounding bar 23 comprises an elongate, laterally extending main portion 232 and a plurality of grounding fingers 234 extending forwardly from the main portion 232.

The shield 3 comprises an upper plate 31, a lower plate 32, and a pair of connecting portions 33 connecting rear portions of the upper plate 31 and the lower plate 32. A receiving space 34 is defined between the upper and the lower plates 31 and 32. A pair of side portions 322 extends from a pair of lateral ends of the upper plate 31 to the lower plate 32. A plurality of resilient tabs 324 extends from the upper plate 31 into the receiving space 34 and a plurality of apertures 326 is defined in the upper plate 31. A pair of resilient bars 312 extends from the lower plate 32 into the receiving space 34.

Each latch device 4 comprises a U-shaped body portion 410 which has a top plate 411, a bottom plate 412, and a side plate 413 connecting side edges of the top and bottom plates 411, 412. The top plate 411, the bottom plate 412, and the side plate 413 together define a receiving cavity 416. The top plate 411 has a latch portion 414 in a configuration of a claw extending forwardly from a front end thereof. The latch portion 414 extends through a corresponding passageway 148 when the latch device 4 is mounted on a corresponding retention portion 14. A retaining hole 415 is defined through the bottom plate 412 of the body portion 410. A spring tab 417 extends forwardly from a rear end of the side plate 413 of the body portion 410 and in a direction away from the side plate 413. A tab 419 is formed by the side plate 413 and extends inwardly. The tab 419 is used for engaging in a depression 143 defined in a side face of a corresponding retention portion 14 when the latch device 4 is mounted on the corresponding retention portion 14, whereby the latch device 4 can be more stably mounted to the corresponding retention portion 14.

The grounding plate 24 has a connecting section 242, a plurality of grounding finger 244 and a pair of grounding beam 246 extending from two opposite ends of the connecting section 242. Each of the grounding beam 246 is generally in the shape of the latter L so that a free end thereof may reliably engage with the grounding bar 23.

The cables 6 comprises a plurality of high speed wires 61 and a plurality of power wires 62. Each high speed wire 61 is a differential pair wire which has a pair of conductors and each power wire 62 has a conductor.

Figure 5:
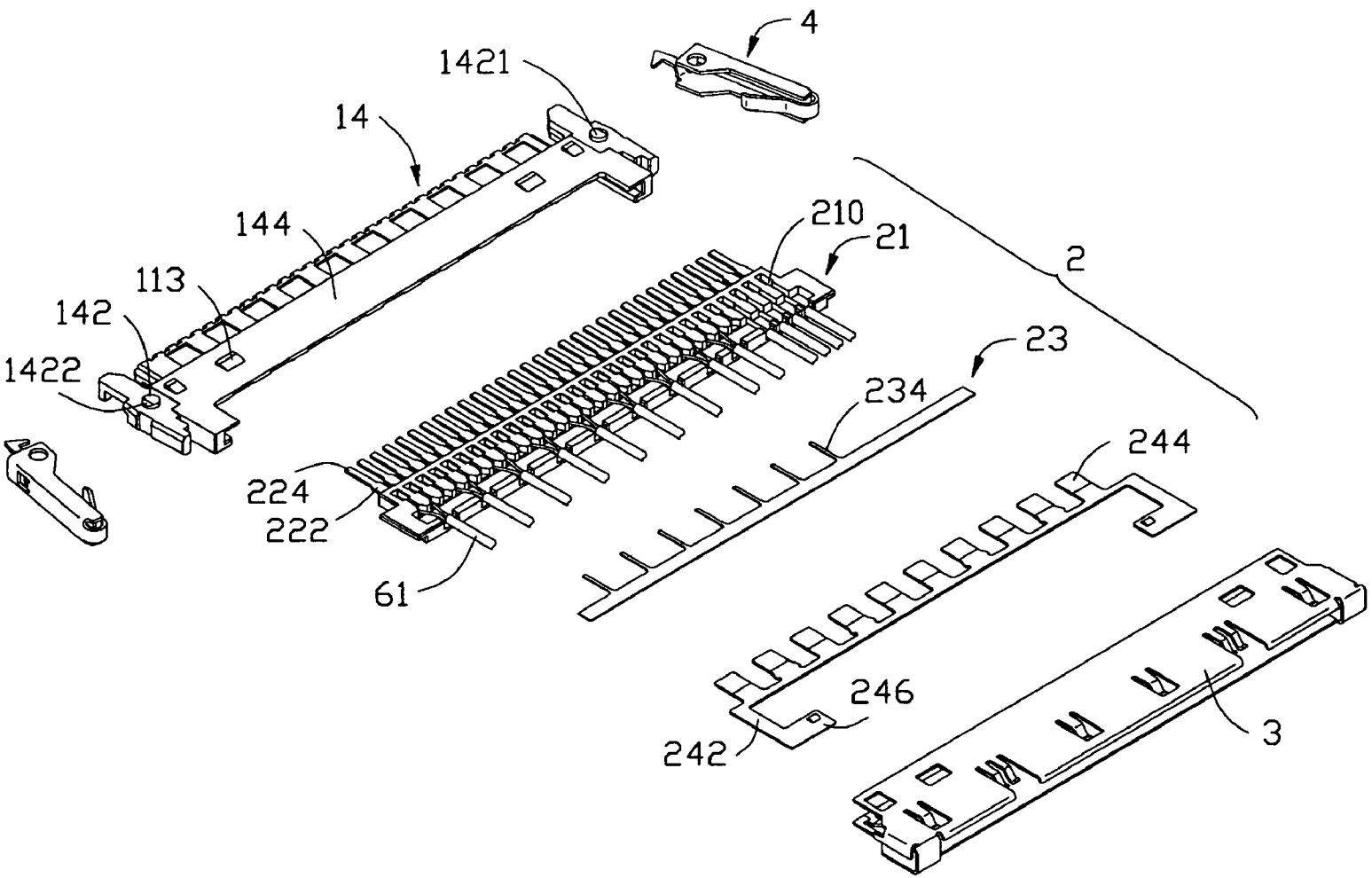
FIG. 5 is a partly assembled view of a contact set of the micro coaxial cable assembly of FIG. 1 with a plurality of contacts and cables assembled into an insulative insert.
Figure 6:
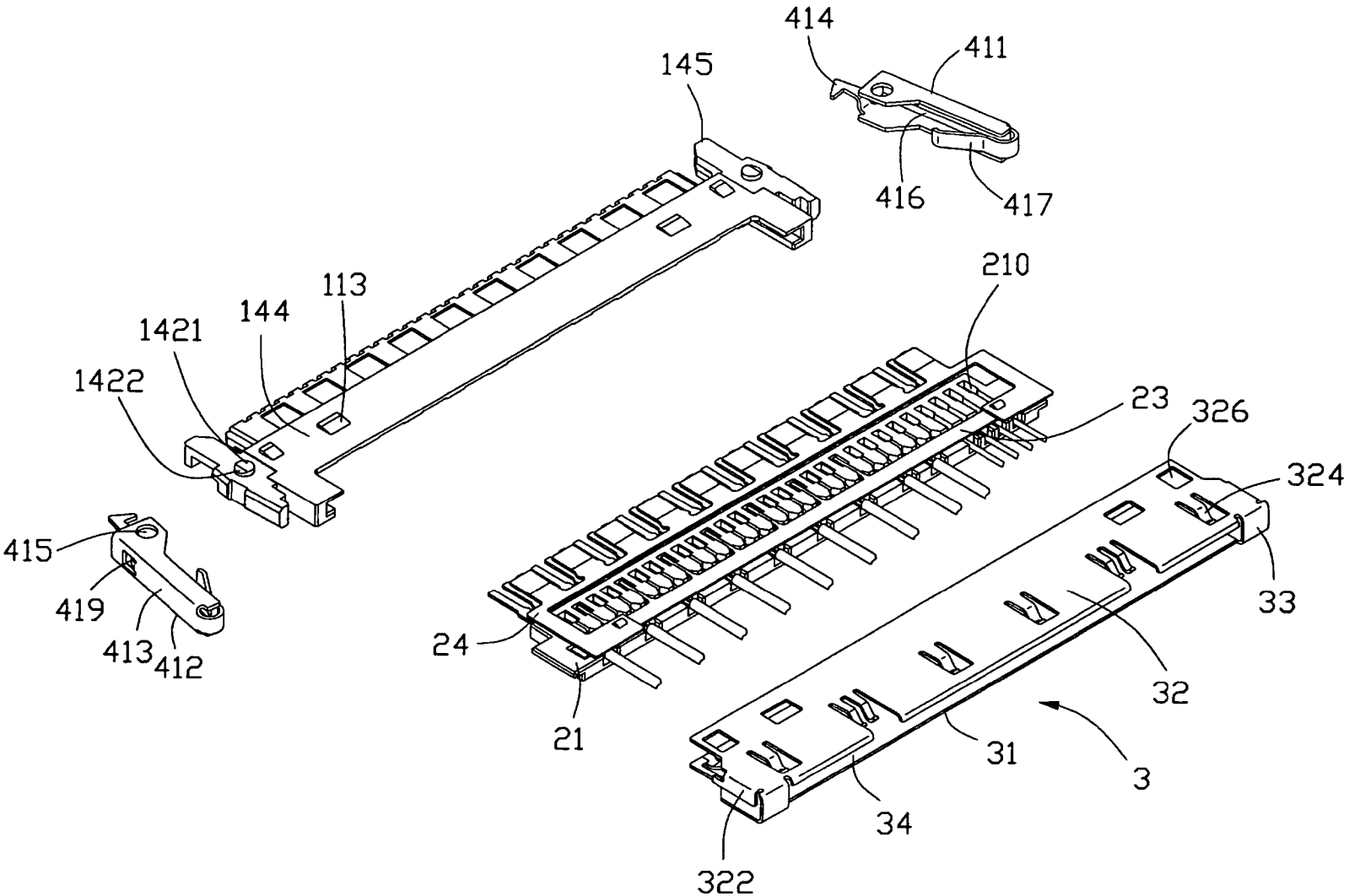
FIG. 6 is a partly assembled view of the micro coaxial cable assembly with the contact set completely assembled together.

In assembly, also referring to FIGS. 5 and 6, the signal and grounding contacts 22 are respectively inserted into the channels 210 with the connecting sections 226 of the contacts 22 received in the channels 210, the retention sections 222 and the mating sections 224 extending forwardly beyond a front face of the insert 21. The soldering surfaces 2262 of the connecting sections 226 of the contacts 22 are exposed to the channels 210. The conductors of the high speed wires 61 and power wires 62 are placed on the soldering surfaces 2262 of the contacts 22. A plurality of solders is placed into corresponding channels 210 which the conductors placed therein and attached on the soldering surfaces 2262 of the contacts 22 and the conductors. Hot air reflow coming from a heating machine blows to the mating sections 224 so that the heat energy is efficiently applied and transferred to the solders from the contacts 22. Thus, the solders are melted and solder the connecting sections 226 of the contacts 22 and the conductors together. The grounding bar 23 is assembled to the receiving groove 212 with the grounding fingers 234 entering into the channels 210 and attached on the soldering surfaces 2262 of the contacts 22 and the main portion 232 received into the receiving groove 212. Later, the grounding fingers 234 are soldered to the soldering surfaces 2262 of the corresponding contacts 22 and the main portion 232 of the grounding bar 23 are soldered to the conductors of the high speed wire 61 and power wire 62 exposed in the receiving groove 212. Because the upper surface 2242 of the mating section 224 is not coplanar to and higher than the soldering surface 2262 of the connecting section 226 of the contact 22, when the solders on the soldering surface 2262 of the connecting section 226 is melted, the melted solder can not climb and flow to the upper surface 2242 of the mating section 224. The grounding plate 24 is attached on the insulative insert 21, therefore the contact set 2 is assembled together.

The contact set 2 is then assembled to the elongate plate 131 of the rear portion 13 of the insulative housing 1 with lateral ends of the contact set 2 received in the receiving channels 133 of the receiving sections 132, respectively, and the retention sections 222 and the mating sections 224 of the contacts 22 extending into the passageways 111 of the housing 1, wherein the retention sections have an interferential fit with the housing 1. Because the melted solders do not climb and reflow to the retention section 222 and the mating section 224 of the contact 22; thus, the insulative insert 21 is easy to assembly to the insulative housing 1 and does not increase interference between the housing 1 and contacts 22.

The housing 1 is assembled into the receiving space 34 of the shield 3 with the plurality of protrusions 113 fitted into the apertures 326, the resilient tabs 324 extending into the receiving groove 212 and engaging with the grounding bar 23, and the resilient bars 312 engaging in the recesses 115 of the base portion 11 of the housing 1. The grounding plate 24 is located between the insert 21 and the upper plate 3 of the shield 3. Thus, the insulative housing 1, the contact set 2, the shield 3 are assembled together.

Figure 7:
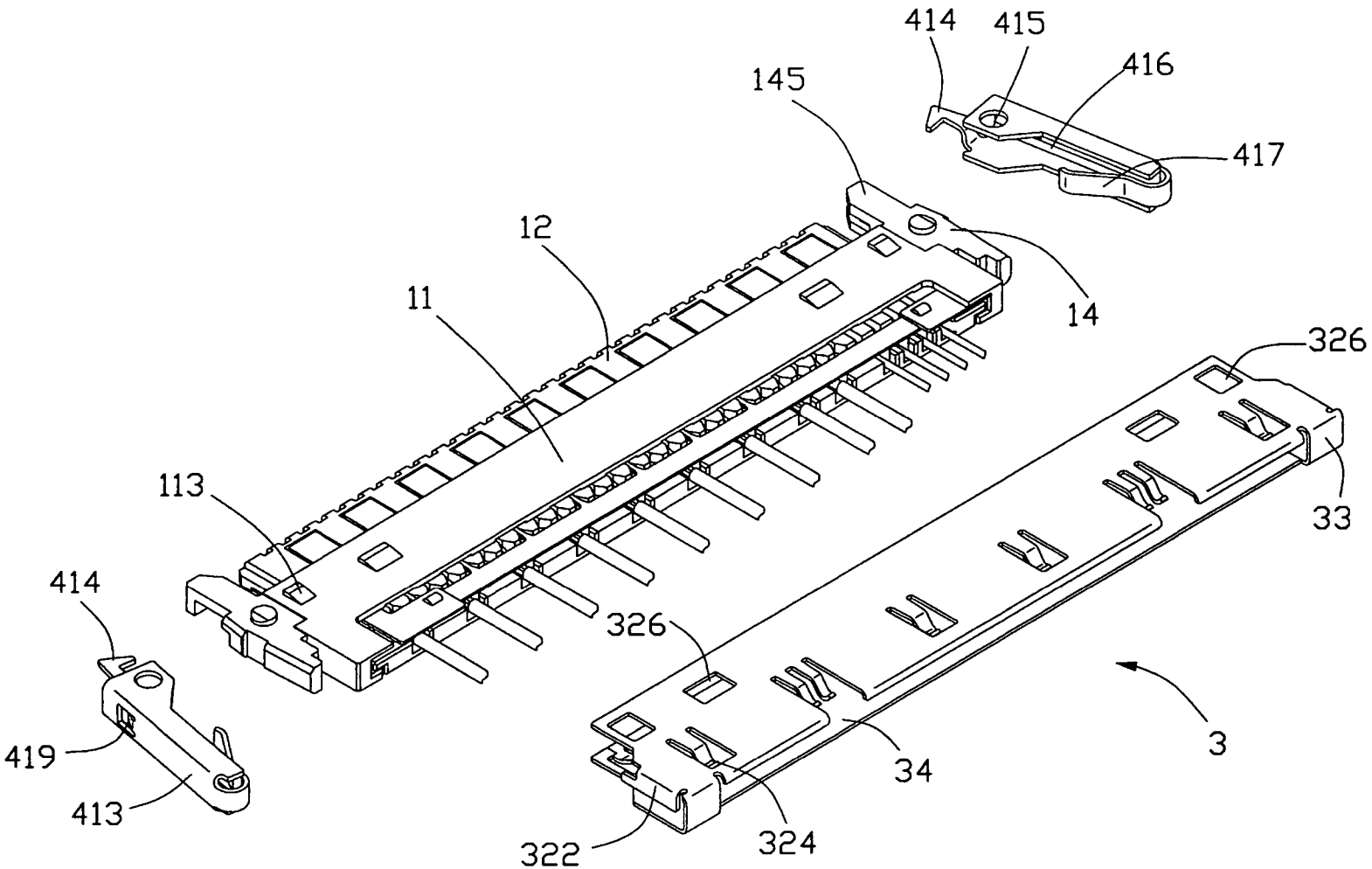
FIG. 7 is a partly assembled view of the micro coaxial cable connector assembly of FIG. 1 with the contact set assembled to an insulative housing.
Figure 8:
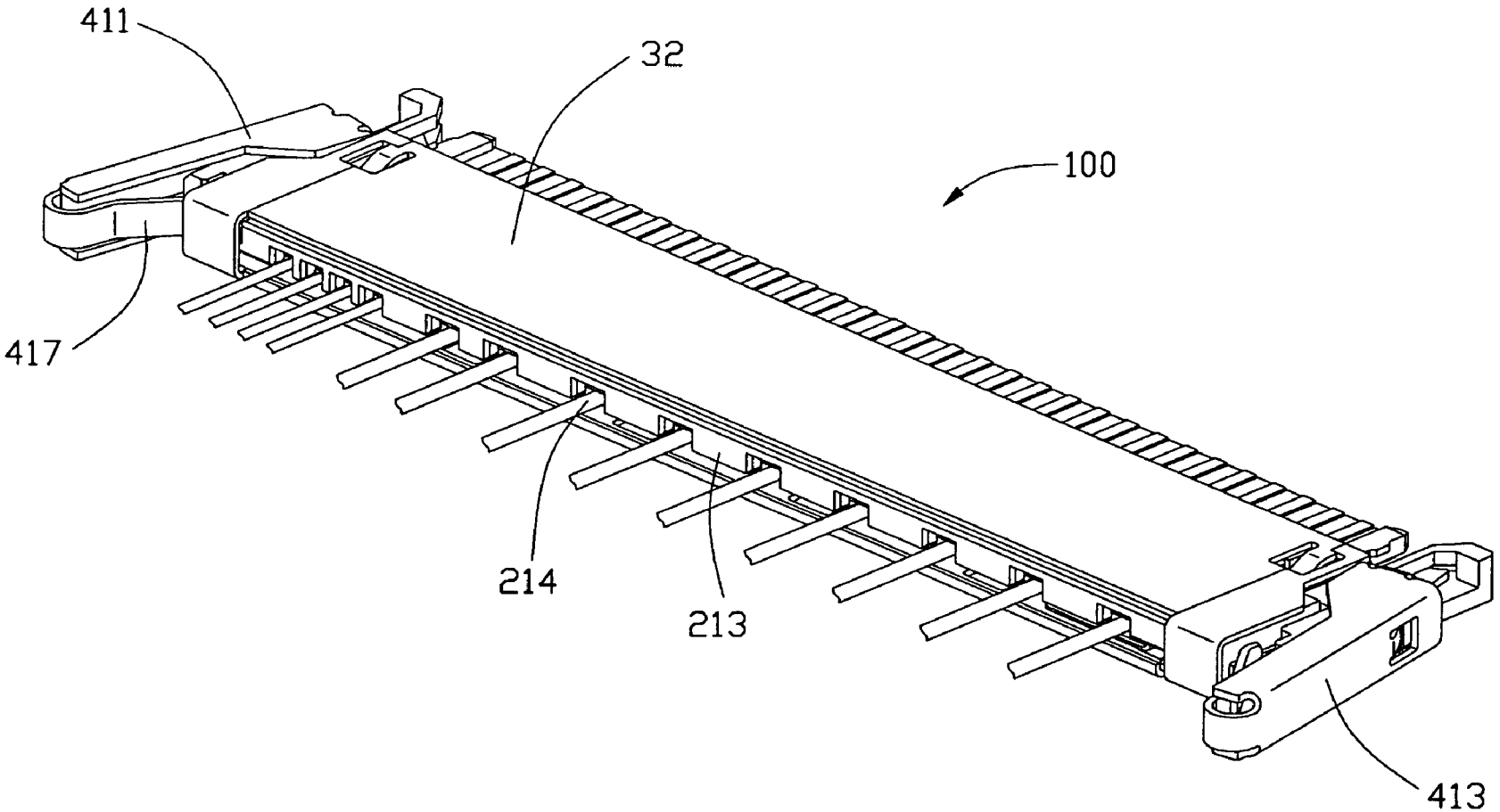
FIG. 8 is a completely assembled view of the micro coaxial cable assembly of FIG. 1.

Referring to FIGS. 7 and 8, the latch devices 4 are respectively assembled to the retention portions 14 of the housing 1 from laterally outside of the housing 1 to a position wherein the retention portions 14 are respectively inserted into the receiving cavities 416 of the body portions 410. The retention posts 142 are fitted into the retaining holes 415 so that the latch devices 4 are pivotably mounted on the retention portions 14, respectively. Each latch portion 414 extends through a corresponding passageway 148 to a position in inner of the upright wall 149 of the corresponding guiding post 145. The spring tabs 417 extend into the gaps 15 and resiliently abut against the side portions 322 of the shield 3 so that the latch devices 4 and the shield 3 are electrically connected together. The tabs 419 engage in the depressions 143 to more stably mount the latch devices 4 to the retention portions 14. Accordingly, the micro coaxial cable connector 100 in accordance with the present invention is completed.

When the micro coaxial cable connector 100 engages with the complementary connector (not shown), the latch portions 414 engage in recesses defined by the complementary connector to latch therewith, whereby the connector 100 and the complementary connector are securely connected together. To separate the connector 100 from the complementary connector, rear ends of the latch devices 4 are pushed towards each other to cause the latch devices 4 to pivot about the retention posts 142 in a manner that the latch portions 414 move away from each other. Thus, the latch of the connector 100 with the complementary connector is released and the connector 100 can be pulled to separate from the complementary connector. The tabs 419 have front ends (not labeled) engaging with the insulative housing 1, whereby a pulling force acting on the latch devices 4 by the complementary connector can be resisted by both the retention posts 142 and housing 1 engaging with the front ends of the tabs 419 so that the force acting on the retention posts 142 can be reduced to prevent damage of the retention posts 142 due to the pulling force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an elongate insulative housing having a base portion, a plurality of passageways defined in the base portion, and an insulative insert in a rear end thereof;

a plurality of signal and grounding contacts each comprising a mating section extending beyond the insulative insert and received into a corresponding passageway of the housing, a connecting section remained in the insert, and a step section between the mating section and the connecting section and rendering the mating section higher than the connecting section;

a grounding bar assembled in the insert, the grounding bar having a plurality of grounding fingers electrically connecting with corresponding grounding contacts; and a plurality of cables extending into the insulative insert and electrically soldered to the connecting sections wherein the cable comprises a plurality of high speed wires that are differential pairs electrically soldered to corresponding signal contacts.

2. The electrical connector assembly as described in claim 1, further comprising a grounding plate having a plurality of grounding fingers and at least one grounding beam, said at least one grounding beam electrically contacting the grounding bar.

3. The electrical connector assembly as described in claim 1, wherein a pair of retention portions is formed at a pair of lateral ends of the base portion, and a pair of latch devices is pivotably mounted to the retention portions, each latch device having a latch portion for latching with a complementary connector and a tab engaging with the housing for resisting a pulling force acting on the each latch device from the complementary connector.

4. The electrical connector assembly as described in claim 3, wherein latch each latch device portion has a body portion enclosing and securely assembled pivotably mounted on the a corresponding retention portion of the housing, and the engaging latch portion extends forwardly from the body portion.

5. The electrical connector assembly as described in claim 1, wherein the connector further comprising a shield enclosing the housing.

6. The electrical connector assembly as described in claim 5, wherein the shield has a pair of side portions formed on a pair of lateral ends thereof, and each latch portion device has a spring tab extending from the body portion and abutting against the a corresponding side portion of the shield.

7. A method for making an electrical connector assembly comprising:

providing an elongate insulative housing having a base portion and a plurality of passageways defined in the base portion;

providing an insulative insert having a plurality of channels;

providing a plurality of signal and grounding contacts each having a connecting section retained in the channel, a mating section extending beyond the insulative insert and a step section between the mating section and the connecting section and rendering the mating section higher than the connecting section;

providing a plurality of cables each having a conductor placed into the channel and connecting with the connecting section of the contact;

placing a plurality of solders into the channels;

heating the mating sections of the contacts so that the solders are melted and solder the connecting sections and the conductors together; and assembling the insulative insert to the housing with the mating sections wherein the connector assembly further comprises a grounding bar assembled to the insulative insert, the grounding bar having a plurality of grounding fingers soldered to the connecting sections of the contacts received into the passageways.

8. The method of making the electrical connector assembly as described in claim 7, wherein the connector assembly further comprises a shield enclosuring the housing therein.

* * * * *